United States Patent [19]

Shiflett

[11] 4,378,781

[45] Apr. 5, 1983

[54] ARROW LOCATING DEVICE

[76] Inventor: David C. Shiflett, 2001 Berkley, Flint, Mich. 48504

[21] Appl. No.: 255,162

[22] Filed: Apr. 17, 1981

[51] Int. Cl.[3] ..... F41B 5/00

[52] U.S. Cl. ..... 124/24 R; 242/146; 242/171; 124/88; 273/DIG. 30; 273/413; 273/416; 273/DIG. 24

[58] Field of Search ..... 124/24 R, 23 R, 41 A, 124/80, 88; 273/319; 43/6

[56] References Cited

U.S. PATENT DOCUMENTS

| | | | |
|---|---|---|---|
| 736,051 | 8/1903 | Adams | 124/24 R |
| 2,809,833 | 10/1957 | Slade | 273/DIG. 24 |
| 2,812,756 | 11/1957 | Myers | 124/88 X |
| 2,938,514 | 5/1960 | Berg | 124/24 R |
| 3,377,999 | 4/1968 | Reynolds | 124/24 R |
| 4,309,974 | 1/1982 | Carter et al. | 124/23 R |

*Primary Examiner*—Richard C. Pinkham
*Assistant Examiner*—William R. Browne
*Attorney, Agent, or Firm*—Fisher, Gerhardt, Crampton & Groh

[57] ABSTRACT

An arrow locating device for use with archery equipment which includes a hollow spool of line for dispensing the line axially from internally of the spool. The spool is fastened to a bow and has the free end of the line attached to the arrow so that upon shooting the arrow, the line is unwound from the spool making it easier to trace the arrow. The spool is provided with an attaching arrangement making it possible for the spool to be carried directly on the arrow until the arrow is noched in readiness for shooting and makes it possible to rapidly reload for subsequent shots.

8 Claims, 4 Drawing Figures

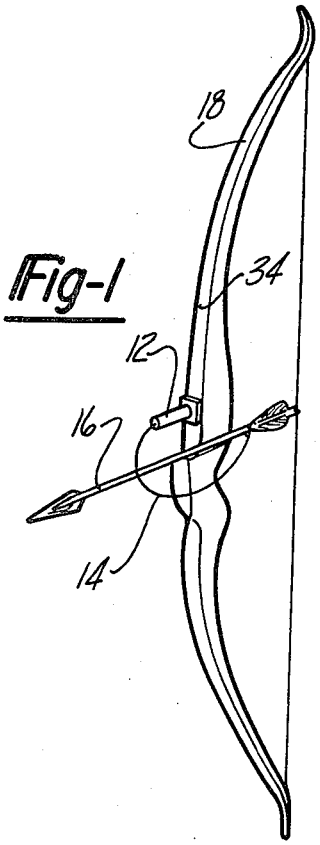
Fig-1
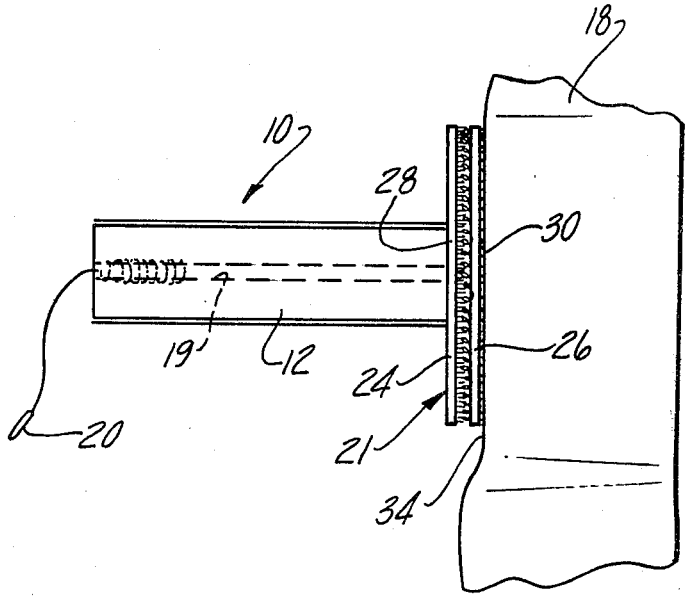
Fig-2
Fig-3
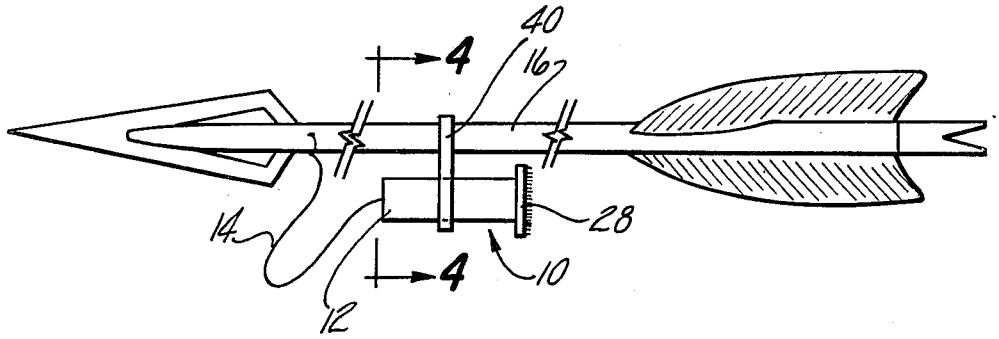
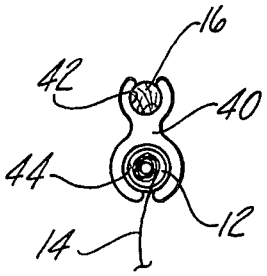
Fig-4

ARROW LOCATING DEVICE

This invention relates to archery equipment and more particularly to an archery accessory facilitating the location of arrows and game.

In the sport of hunting with archery equipment, the tracking of game which may be wounded with an arrow and the recovery of arrows which have missed their mark has been facilitated by devices which have employed the use of a flexible line attached to the arrow and unwound from a supply of such line mounted on the archery bow. Typically, such arrangements have both ends of the line secured to the arrow and to the bow, respectively. With such prior art arrangements, when an arrow is shot and its mark is missed, the cord must be rewound on a reel or spool or the line is cut and abandoned and a new end from the supply of line is tied to another arrow.

It has been found that the recovery of arrows and the tracking of game hit by arrows can be facilitated by the use of brightly colored or florescent cord attached to the arrow and fed from a consumable spool having a length of cord substantially equal to the maximum range of an arrow. With such an arrangement, when a game animal is hit and wounded but continues to move, the entire spool of cord can become unwound from the bow. Nevertheless, the attached cord, which can be several hundred feet long, makes it easier to track the game.

It is an object of the invention to provide an arrow locating accessory for archery equipment in which a line is attached to an arrow for dispensing from a supply of line upon flight of the arrow and in which the supply of line is rapidly attachable to and detachable from the archery bow.

It is still another object of the invention to provide an arrow locating device for archery equipment in which a supply of line which has one end attached to an arrow is temporarily supported on the arrow in readiness for rapid detachment from the arrow and attachment to the bow thereby making rapid reloading possible.

The objects of the invention are accomplished by an arrow locating device for use with an archery bow and arrow in which a hollow spool of line is coiled for dispensing the line axially from internally of the spool. The exterior of the spool is sheathed with plastic or wax to prevent fraying of lines from the spool. The spool is provided with attaching means for securing the spool to a bow which is made up of complementary hook-and-eye material having one of the elements of such material attached to the spool and the other element of such material attached to the bow. The free line of the spool of line is attached to an arrow so that when an arrow is shot from the bow, line is unwound from the spool making it easy to locate the arrow. Also a second attaching means is provided which includes a flexible element having a notch receiving the shaft of the arrow and a second notch receiving the spool of line so that the spool may be temporarily attached to the shaft of an arrow making it possible to have a plurality of arrows each prepared in readiness for attachment of the spool to the bow so that repeated shots can be made without delay.

The objects of the invention are accomplished by the embodiment disclosed in the following description and illustrated in the drawings in which:

FIG. 1 shows the arrow locating device embodying the invention in use with an archery bow and arrow;

FIG. 2 is an enlarged view of the archery locating device seen in FIG. 1;

FIG. 3 is a view of the arrow locating device shown in association with an arrow; and FIG. 4 is a cross-sectional view taken on line 4—4 in FIG. 3.

Referring now to the drawings, the arrow locating device is indicated generally at 10 and includes a spool 12 of line 14 having one end attached to an arrow 16 with the remainder of the line supported on a bow 18 from which the arrow is about to be shot.

Spool 12 is preferably made up of a winding of line 14 which in one form can be nylon floss of a bright color or a florescent color. The spool 12 is generally cylindrical and tubular and can be considered to have a hollow core 19. It is so wound that the line can be dispensed axially from one end of the spool until the entire spool of line is consumed. The outer surface of the spool can be provided with a plastic or wax coating to form a skin preventing unraveling. As seen in FIG. 2, the free end of the line 20 also is coated with plastic or wax to facilitate threading through a hole and attachment to an arrow. In FIG. 1, the free end of line 14 is shown attached to the fletched end of arrow 16 which would be the case with bows of the type illustrated. In FIG. 3, the line 14 is attached to the head end of the arrow 16 which typifies the attachment used with compound bows to prevent entanglement with the cable mechanism.

The spool 12 is detachably attachable to an archery bow by means of an attaching assembly 21 including hook-and eye fastening material which is commercially available under the trademark VELCRO. Such material includes a hook portion 24 and an eye portion 26. One or the other of the hook 24 or eye portions 26 can be secured to the end of the spool 12 directly by adhesive indicated at 28. The other complementary hook-and-eye material portion 24, 26 is provided with a pressure sensitive adhesive strip 30 which can be temporarily covered with a removable cover material, not shown. To attach the spool 12 to an archery bow 18 it is necessary simply to remove the cover and press the adhesive strip 30 onto a face surface 34 of the bow which will permit the spool 12 to be substantially axially aligned with the path of the arrow 16. Typically the hook or eye portion of material 24, 26 is located on the bow 18 and remains on the bow for subsequent use.

To facilitate such use, the arrow locating device 10 is provided with a bracket element 40 made of flexible, rubber-like material. The bracket element 40 is provided with an open slot 42 which can be placed on the shaft of an arrow 16 and a similar but larger slot 44 which embraces the exterior of a full spool 12 of line 14. This makes it possible to locate a spool 12 on each of the hunting arrows 16 that a hunter may have in his quiver with the free end of the line 14 from the spools associated with the arrows already fastened in position in readiness for subsequent use. With the bow associated hook or eye material 24 or 26 already mounted in position on the bow 18, the complementary portion 24 or 26 which includes the pressure sensitive strip 30 and cover 32 can be removed from each of the spools 12 associated with the arrows in the quiver.

Upon attachment of the spool 12 to the bow 18, the bracket element 40 can be removed for a subsequent use although it can remain with the spool 12 without interferring with the function of the locating device 10.

After the bow has been prepared with an attaching strip 24 or 26, the archer readies his equipment for shooting by removing the bracket element 40 together with spool 12 from the arrow 16 and applies the hook or eye portion 24 or 26 on the end of the spool 12 directly to the complementary hook or eye portion on the bow 18. This attaches the spool 12 to the bow and with the line already attached to the arrow, it can be noched and the archer is ready to shoot.

Upon shooting an arrow 16 from the bow 18 the line 14 is unwound from the spool 12 which either partially or fully unwinds the entire spool making it possible to more easily locate the arrow or any game that may have been hit.

An arrow locating device for an archery bow has been provided in which a hollow spool of line is detachably attached to a bow and has its free end connected to the arrow so that when the arrow is shot its path of flight can be more easily traced. Attaching means are provided for carrying the spool on the arrow until it is needed for shooting making it possible for a number of arrows to be preliminary prepared by attaching lines from a like number of spools to the arrows. Such arrows can be carried in a quiver so that repeated shots are possible each with the benefit of an arrow locating device.

The embodiments of the invention in which an exclusive property or privilege is claimed are defined as follows:

1. An arrow locating device for use with an archery bow and arrow for locating the arrow after flight from a bow, the combination comprising: a hollow spool of line coiled for dispensing said line axially from internally of said spool, attaching means at one end of said spool engageable with complementary attaching means adapted to be fixed on a bow to dispose said spool with its axis generally parallel to the path of an arrow, said line having one end attachable to an arrow for pulling line from said spool upon discharge of said arrow from said bow, and second attaching means for supporting said spool on an arrow in readiness for detachment from said arrow and attachment to said bow.

2. The device according to claim 1 wherein said spool is formed by said line and is consumable and expendable upon unreeling of all of said line.

3. The device of claim 1 wherein said line is florescent.

4. The device of claim 1 wherein said attaching means and complementary attaching means is formed by elements of complementary hook-and-eye material attachable to said bow and to said spool, respectively.

5. The device of claim 1 wherein said second attaching means includes a bracket element detachably connected to the shaft of an arrow and detachably connected to the exterior of said cylindrical spool.

6. The device of claim 5 wherein said bracket element comprises a resilient member having a first notch releasably receiving an arrow shaft and a second notch releasably receiving said spool.

7. The arrow locating device of claim 1 wherein said attaching means includes one element of a hook-and-eye assembly connected to said spool and the other element of said assembly connected to said bow.

8. An arrow locating device for use with an archery bow and arrow for locating the arrow after flight from the bow, comprising: a hollow spool of line coiled for dispensing said line axially from internally of said spool, a skin of material formed on the exterior of said spool, attaching means connected to one end of said spool and being engageable with complementary attaching means fixed on a bow to dispose said spool with its axis generally parallel to the path of an arrow, said line having an end attachable to an arrow for pulling line from said spool upon discharge of said arrow from said bow, second attaching means connected to said spool and having a portion adapted to receive an arrow shaft to support said spool relative to said shaft, said spool being detachable from said arrow and attachable to said bow.

* * * * *